US007730578B1

(12) United States Patent
Curren

(10) Patent No.: US 7,730,578 B1
(45) Date of Patent: Jun. 8, 2010

(54) REMOVABLE ERASER FOR A PENCIL

(76) Inventor: Andrew Curren, 3401 Via Palomino, Palos Verdes, CA (US) 90274

( * ) Notice: Subject to any disclaimer, the term of this patent is extended or adjusted under 35 U.S.C. 154(b) by 0 days.

(21) Appl. No.: 12/335,343

(22) Filed: Dec. 15, 2008

(51) Int. Cl.
*B43L 19/00* (2006.01)

(52) U.S. Cl. ..... 15/427; 15/431

(58) Field of Classification Search ..... 15/424–434
See application file for complete search history.

(56) References Cited

U.S. PATENT DOCUMENTS

| | | | | | |
|---|---|---|---|---|---|
| 85,961 | A | | 1/1869 | Reckendorfer | |
| RE3,863 | E | | 3/1870 | Reckendorfer | |
| 126,224 | A | | 4/1872 | Müller | |
| 126,792 | A | | 5/1872 | Evans | |
| 144,337 | A | | 11/1873 | Illfelder | |
| RE6,510 | E | * | 6/1875 | Blair | 15/427 |
| RE6,766 | E | | 11/1875 | Tower | |
| RE6,767 | E | | 11/1875 | Tower | |
| 178,882 | A | | 6/1876 | Sheldon | |
| 667,950 | A | * | 2/1901 | Oelke | 15/431 |
| 786,130 | A | | 3/1905 | Makant | |
| 854,488 | A | * | 5/1907 | Goldsmith | 15/431 |
| 889,932 | A | | 6/1908 | Kenny | |
| 916,987 | A | | 4/1909 | Bowen | |
| 1,267,955 | A | * | 5/1918 | Balch | 15/430 |
| 1,352,677 | A | * | 9/1920 | Moore | 401/52 |
| 1,551,959 | A | | 9/1925 | Klein | |
| 1,812,701 | A | | 6/1931 | Jones | |
| 1,942,283 | A | * | 1/1934 | Hale | 15/105.51 |
| D91,575 | S | | 2/1934 | Van Dorn | |
| 1,998,684 | A | * | 4/1935 | Musgrave | 15/431 |
| 2,074,016 | A | | 3/1937 | Coryell | |
| 2,144,006 | A | | 1/1939 | Wilson | |
| 2,180,132 | A | * | 11/1939 | Zoll | 15/427 |
| 2,239,526 | A | * | 4/1941 | Juelss | 15/432 |
| 2,283,107 | A | * | 5/1942 | Van Dorn | 15/431 |
| 2,369,047 | A | | 2/1945 | Hasselquist | |
| 2,419,746 | A | | 4/1947 | Veria | |
| 2,448,103 | A | * | 8/1948 | Linden | 15/427 |
| 2,573,760 | A | | 11/1951 | Cherne | |
| 2,577,259 | A | | 12/1951 | Millington | |
| 2,601,129 | A | | 6/1952 | Sams | |
| 2,785,100 | A | | 3/1957 | Yaw | |
| 3,262,425 | A | * | 7/1966 | Waugh | 15/431 |
| D398,935 | S | | 9/1998 | Chevalier | |
| D412,014 | S | | 7/1999 | Izushima | |
| 6,565,275 | B2 | * | 5/2003 | Brand et al. | 401/52 |
| D483,805 | S | | 12/2003 | Ikeda | |
| D508,717 | S | | 8/2005 | Anand | |

(Continued)

FOREIGN PATENT DOCUMENTS

| | | | |
|---|---|---|---|
| JP | 9-66697 | * | 3/1997 |

*Primary Examiner*—Mark Spisich
(74) *Attorney, Agent, or Firm*—Michael Best & Friedrich LLP

(57) ABSTRACT

An eraser to cap a pencil includes a top and a base, with a projection extending between them. The projection helps to secure the top and base together by fitting into and filling a mating cavity within either or both of the top and base. The base has a cavity open at the bottom of the base, sized and shaped to receive the used or unused portion of an original pencil eraser, if any, and the ferrule on the pencil.

7 Claims, 2 Drawing Sheets

U.S. PATENT DOCUMENTS 7,052,128 B1 5/2006 Kung-Ping
D540,867 S 4/2007 Koch
D546,388 S 7/2007 Hung

* cited by examiner

REMOVABLE ERASER FOR A PENCIL

BACKGROUND

Erasers suitable for permanent attachment to a pencil are typically solid and cylindrical in shape. The eraser is attached to the lead-bearing, wooden portion of the pencil by a metal collar or ferrule that permanently attaches the eraser and the lead-bearing portion. Removable erasers for pencils are also known, which typically consist of a tubular bottom integrally formed with an arrow-head shaped top. The tubular bottom is sized to fit over a used (or unused) cylindrical eraser and frictionally engage the ferrule.

SUMMARY

The present pencil eraser includes a top and a base, the base adapted to fit over the top end of a typical pencil that has some, none or all of the original fixed eraser still in the ferrule. The top and base are separately formed and secured together by a projection extending from either the top or the base into a mating cavity formed in the other of the top and base. The base has an open cavity at its bottom to receive the top of the pencil and to permit removal of the eraser from the pencil when desired.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
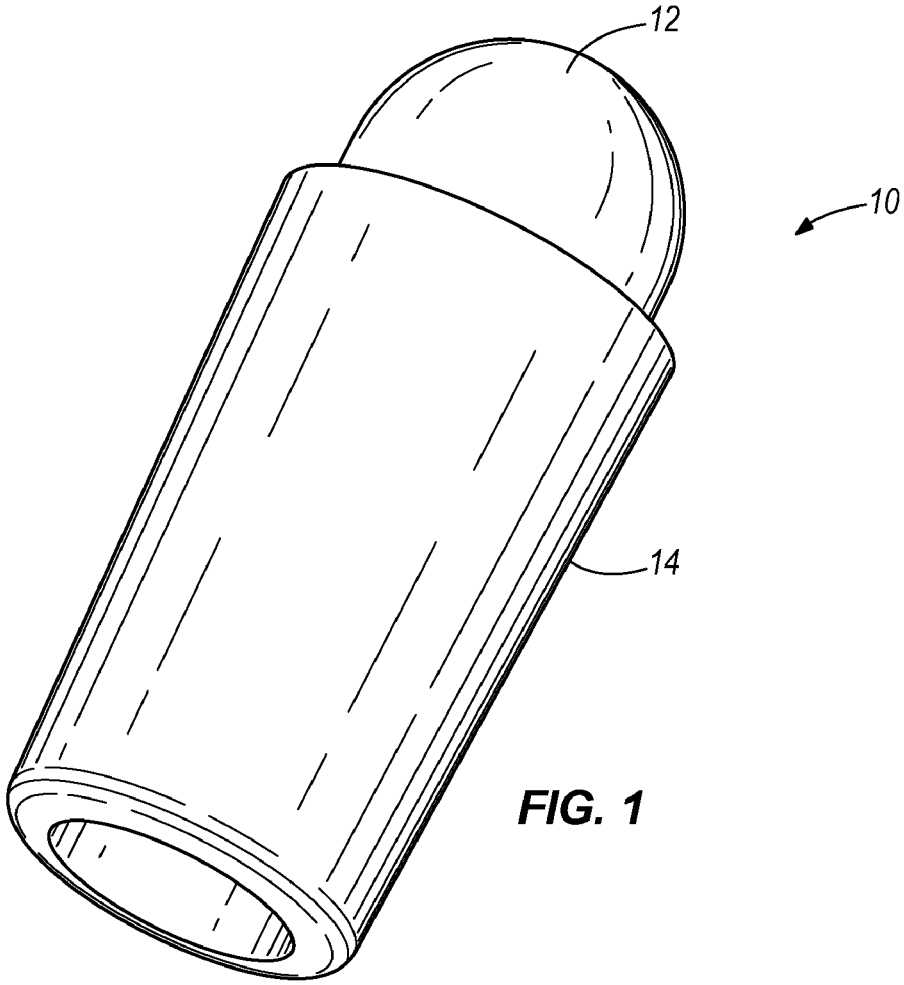
FIG. 1 is a perspective view of a removable eraser for pencils according to the present invention.
Figure 2:
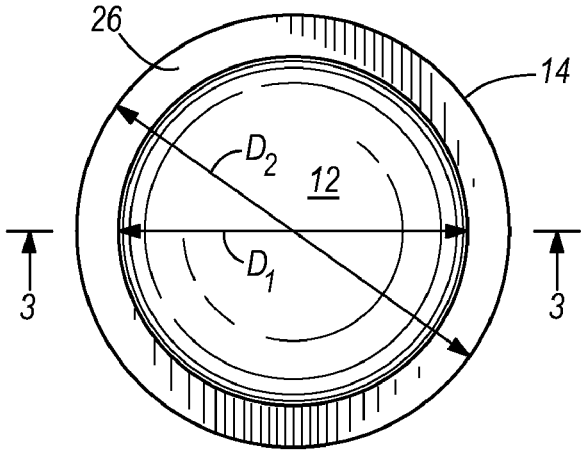
FIG. 2 is a plan view of the eraser of FIG. 1.
Figure 3:
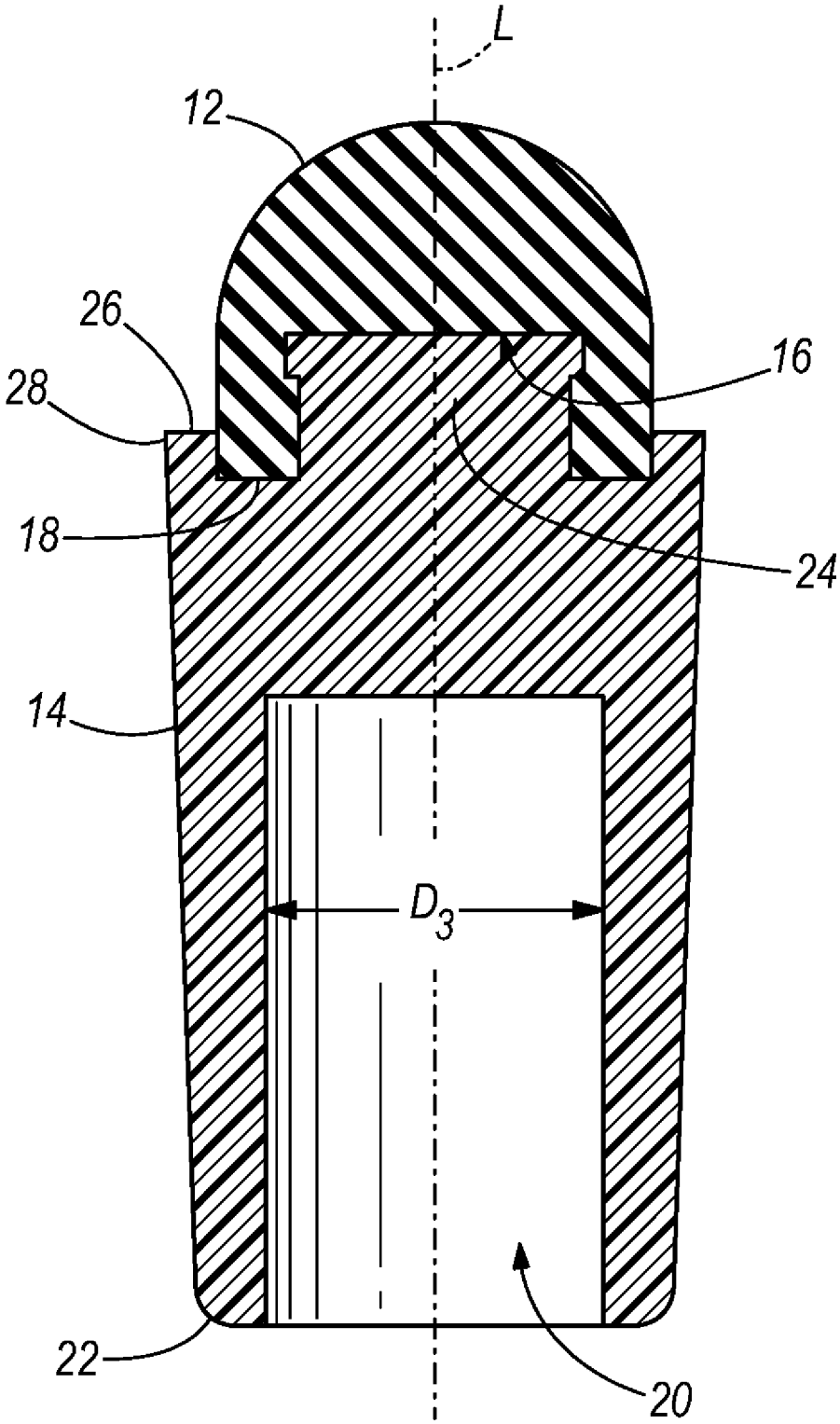
FIG. 3 is a cross sectional view of the eraser of FIG. 1 taken along line 3-3.

A removable eraser 10 for pencils has a top 12 and a base 14. The top and base are composed of the same eraser material, which is a moldable type typically used in the manufacture of erasers. The illustrated top 12 is generally hemispherical and the base 14 is generally cylindrical, but each section may be of various shapes. For example, the top may be cylindrical, cubical, or pyramidal, and the base may be box-shaped or have another polygonal cross-section. As shown in FIG. 2, the diameter $D_1$ of top 12 is less than the diameter of $D_2$ of base 14 so that the eraser 10 imitates the appearance of the original eraser atop a ferrule, but other relative dimensions are possible.

Each of top 12 and base 14 has a cavity. The cavity 16 of the top opens at the bottom or first end 18 of the top, and similarly the cavity 20 of the base opens at the bottom or first end 22 of the base. When the top is properly positioned relative to the base, the cavities 16, are approximately aligned along the same longitudinal axis L.

The cavity 20 of the base 14 is sized and shaped to receive the used or unused portion of a typical, permanently affixed eraser and ferrule on a typical pencil. That means that cavity 20 is cylindrical and has a diameter $D_3$ sufficient to slide over and around the permanently affixed eraser and ferrule of a typical pencil, but $D_3$ is small enough to removably attach the eraser 10 to a pencil with a friction fit.

The upper second end 28 of base 14 is opposite first end 22 and includes an integrally formed projection 24 that extends above the surrounding shoulder 26 of base 14. The projection 24, like cavities 16, 20, is generally aligned along longitudinal axis L so that projection 24 fits within cavity 16 and internally within top 12. Projection 24 opposite cavity 20 is sized and shaped to fit snugly within cavity 16, where it is secured to top 12 as by heat sealing. The cross section of the projection is shown as generally T-shaped, but other configurations can be used, such as L-shape or ball shape. This construction permanently secures the top 12 and base 14 together so that they do not disassemble during use of eraser 10.

Alternatively, a projection could extend from a top into a base, provided that the base had a cavity to receive the projection from the top and lock the top and base together.

As an additional alternative embodiment, a projection separately formed from either the top or the base could extend between them and be received in mating cavities formed in each of the top and bottom. Again, the projection would secure the top and bottom together.

The top and base including the projection as illustrated are separately formed, such as by injection molding. In one example of a manufacturing process, the top is formed first by pouring the raw eraser material into the first mold of the injection machine. The molded top is then inserted into a second mold for the base and projection, and more raw eraser material is allowed to flow into the second mold. In this manner, the base and the projection are formed as a unitary structure, and the projection fills out the cavity in the top. The top and base are heat sealed together and can be removed from the injection machine as one piece.

The removable pencil eraser constructed as described above functions better than the conventional removable arrowhead style eraser, because the arrowhead top bends too much when erasing and consequently abrades too much of the paper or other writing surface. The removable eraser as described herein functions and feels much like the original eraser in the pencil. Further, the separate construction of the top and base permits the eraser to be produced in two different colors, one color for the top and a different color for the base. That provides a more attractive and distinctive look to the eraser and the pencil. When the eraser top and base are to be different in color, an injection co-molding process can be used to make the top and base simultaneously, with each of them a different color.

The invention claimed is:

1. A pencil eraser comprising:

a top composed of eraser material;

a base composed of eraser material, the base having a cavity open at a bottom of the base; and a projection extending between the base and the top securing them together;

wherein one of the top and base has a second cavity that is sized and shaped to receive the projection on the other of the top and base, and wherein the projection and cavity are both T-shaped in cross-section.

2. The pencil eraser of claim 1 wherein the base is generally cylindrical.

3. The pencil eraser of claim 1 wherein the top has a first diameter and the base has a second diameter, and the first diameter is less than the second diameter.

4. The pencil eraser of claim 1 wherein the projection is integral with the base.

5. The pencil eraser of claim 1 wherein the projection is integral with the top.

6. A pencil eraser comprising:

a top composed of eraser material, the top having a cavity formed in a first end of the top;

a base composed of eraser material formed separately from the top, the base having a cavity in a first end and a projection extending from a second end, the projection sized and shaped to mate with the cavity in the top, and wherein the cavity in the base is sized and shaped to mate with a pencil top; and wherein the cavity in the top and the projection each have a generally T-shaped cross section.

7. The pencil eraser of claim 6 wherein the top is a first color and the base is a second color.

* * * * *